US005271824A

United States Patent [19]

Forester et al.

[11] Patent Number: 5,271,824

[45] Date of Patent: Dec. 21, 1993

[54] METHODS FOR CONTROLLING FOULING DEPOSIT FORMATION IN A LIQUID HYDROCARBONACEOUS MEDIUM

[75] Inventors: David R. Forester, Conroe; Paul V. Roling, Spring, both of Tex.

[73] Assignee: Betz Laboratories, Inc., Trevose, Pa.

[21] Appl. No.: 3,187

[22] Filed: Jan. 12, 1993

[51] Int. Cl.[5] ..... C10G 9/16; C10M 151/00; C10M 157/06

[52] U.S. Cl. ..... 208/48 AA; 585/950; 44/435

[58] Field of Search ..... 208/48 AA; 585/950; 252/48.2; 44/435

[56] References Cited

U.S. PATENT DOCUMENTS

| | | | |
|---|---|---|---|
| 3,250,712 | 5/1966 | Coffield | 44/435 |
| 3,326,800 | 6/1967 | Coffield | 44/435 |
| 3,358,470 | 1/1967 | Gillespie | 208/48 AA |
| 3,364,130 | 1/1968 | Barnum | 208/48 AA |
| 3,553,270 | 1/1971 | Wollensak et al. | 260/609 |
| 4,578,178 | 3/1986 | Forester | 208/48 AA |
| 4,707,300 | 11/1987 | Sturm et al. | 252/404 |
| 4,749,468 | 6/1988 | Roling et al. | 208/48 AA |
| 4,810,354 | 3/1989 | Roling et al. | 208/48 R |
| 4,883,580 | 11/1989 | Roling et al. | 208/177 |
| 4,894,139 | 1/1990 | Roling et al. | 208/48 AA |
| 4,927,519 | 5/1990 | Forester | 208/48 R |
| 5,030,369 | 7/1991 | Emert et al. | 252/51.5 A |

*Primary Examiner*—Theodore Morris
*Assistant Examiner*—Patricia L. Hailey
*Attorney, Agent, or Firm*—Alexander D. Ricci; Philip H. Von Neida

[57] ABSTRACT

Sulfur containing Mannich reaction product compounds are used as effective antifoulants in liquid hydrocarbonaceous mediums, such as crude and gas oil distillates during processing of such liquids at elevated temperatures.

8 Claims, No Drawings

METHODS FOR CONTROLLING FOULING DEPOSIT FORMATION IN A LIQUID HYDROCARBONACEOUS MEDIUM

FIELD OF THE INVENTION

The present invention relates to the use of sulfur-containing Mannich reaction products to inhibit fouling in liquid hydrocarbonaceous mediums during the heat treatment processing of the mediums, such as in refinery processes.

BACKGROUND OF THE INVENTION

In the processing of petroleum hydrocarbons and feed stocks, such as petroleum processing intermediates, and petrochemicals and petrochemical intermediates, e.g., gas, oils and reformer stocks, chlorinated hydrocarbons and olefin plant fluids, such as deethanizer bottoms, the hydrocarbons are commonly heated to temperatures of 400° C. to 550° C., frequently from 200° C. to 550° C. Similarly, such petroleum hydrocarbons are frequently employed as heating mediums on the "hot side" of heating and heating exchange systems. In virtually every case, these petroleum hydrocarbons contain deposit-forming compounds or constituents that are present before the processing is carried out. Examples of these preexisting deposit forming materials are alkali and alkaline earth metal-containing compounds, such as sodium chloride; transition metal compounds or complexes, such as porphyrins or iron sulfide; sulfur-containing compounds, such as mercaptans; nitrogen-containing compounds, such as pyrroles; carbonyl or carboxylic acid-containing compounds; polynuclear aromatics, such as asphaltenes; and/or coke particles. These deposit-forming compounds can combine or react during elevated temperature processing to produce a separate phase known as fouling deposits, within the petroleum hydrocarbon. In all cases, these deposits are undesirable by-products.

In many processes, the deposits reduce the bore of conduits and vessels to impede process throughput, impair thermal transfer, and clog filter screens, valves and traps. In the case of heat exchange systems, the deposits form an insulating layer upon the available surfaces to impede heat transfer and necessitate frequent shut-downs for cleaning. Moreover, these deposits reduce through-put, which of course results in a loss of production capacity with a drastic effect in the yield of finished product. Accordingly, these deposits have caused considerable concern to the industry.

While the nature of the foregoing deposits defies precise analysis, they appear to contain either a combination of carbonaceous phases which are coke-like in nature, polymers or condensates formed from the petroleum hydrocarbons or impurities present therein and/or salt formation which are primarily composed of magnesium, calcium and sodium chloride salts. The catalysis of such condensates has been attributed to metal compounds such as copper or iron which are present as impurities. For example, such metals may accelerate the hydrocarbon oxidation rate by promoting degenerative chain branching, and the resultant free radicals may initiate oxidation and polymerization which form gums and sediments. It further appears that the relatively inert carbonaceous deposits are entrained by the more adherent condensates or polymers to thereby contribute to the insulating or thermal opacitying effect.

Fouling deposits are equally encountered in the petrochemical field wherein the petrochemical is either being produced or purified. The deposits in this environment are primarily polymeric in nature and do drastically affect the economies of the petrochemical process. The petrochemical processes include processes ranging from those where ethylene or propylene, for example, are obtained to those wherein chlorinated hydrocarbons are purified.

Other somewhat related processes where antifoulants may be used to inhibit deposit formation are the manufacture of various types of steel or carbon black.

SUMMARY OF THE INVENTION

The present invention provides for methods of inhibiting fouling in heated liquid hydrocarbon mediums utilizing a sulfur-containing Mannich reaction product. Typically, such antifoulant protection is provided during heat processing of the medium, such as in refinery, purification, or production processes.

DESCRIPTION OF THE RELATED ART

U.S. Pat. No. 4,578,178, Forester, discloses a method for controlling the formation of fouling deposits in a petroleum hydrocarbon during processing at elevated temperatures. The antifoulant compound employed is a polyalkenylthiophosphonic acid or ester thereof.

U.S. Pat. No. 4,707,300, Sturm et al., teaches a composition comprising an oxidizable material and a stabilizing amount of an autosynergistic phenolic antioxidant reaction product. The reaction product is produced by admixing a mono-alkylated or 2,4-dialkylated phenol with a primary mercaptan, aqueous formaldehyde and an acid catalyst.

U.S. Pat. No. 3,553,270, Wollensak et al., discloses a process for preparing base catalyzed substituted cresol reaction products. These products were useful as antioxidants in rubber compounds at temperatures up to 280° F.

DETAILED DESCRIPTION OF THE INVENTION

This invention relates to methods for inhibiting fouling in heated liquid hydrocarbon mediums comprising adding an effective antifouling amount of a sulfur-containing Mannich reaction product.

In the absence of such antifouling treatment, fouling deposits are normally formed as a separate phase within said liquid hydrocarbonaceous medium thereby impeding throughout and thermal transfer.

It is to be understood that the phrase "liquid hydrocarbonaceous medium" as used herein signifies various and sundry petroleum hydrocarbons and petrochemicals. For instance, petroleum hydrocarbons such as petroleum hydrocarbon feedstocks including crude oils and fractions thereof such as naphtha, gasoline, kerosene, diesel, jet fuel, fuel oil, gas oil, vacuum residual, etc., are all included in the definition.

Similarly, petrochemicals such as olefinic or naphthenic process streams, aromatic hydrocarbons and their derivatives, ethylene dichloride, and ethylene glycol are all considered to be within the ambit of the phrase "liquid hydrocarbonaceous mediums".

The sulfur-containing Mannich reaction product is derived by admixing a phenol with an alkyldithio compound, an aldehyde compound and an acid catalyst. Phenolic starting materials useful in preparing the reaction product of this invention include monobutylated phenol, 2,4-dibutylated phenol, nonylphenol, 2,4-dinonylphenol, dodecylphenol, methyl and 2,4-dimethylphenols and the like. The inventors anticipate that styrenated phenol, alpha-methylstyrenated phenol, or 2,4-di-styrenated phenol will also be useful in the preparation of sulfur-containing Mannich reaction products. The alkyl substituent may range from 1 to 30 carbon atoms while an arylalkyl substituent will range from 7 to 9 atoms. Preferably, the alkyl substituent will contain from 1-12 atoms.

The alkyldithio compound used in this reaction can be described by the following structure:

HS—R—SH where R is a $C_2$ to $C_8$ linear or branched alkylene.

The aldehyde used in this reaction may be formaldehyde, benzaldehyde, 2-ethylhexanal, salicylaldehyde, butanal, 2-methyl propanal, acetaldehyde or propionaldehyde. Preferably, the aldehyde is formaldehyde, which may be added as monomeric formaldehyde or more preferably a polymeric formaldehyde, e.g. paraformaldehyde. Furthermore, formaldehyde may be added as an aqueous solution, e.g. formalin.

Representative of the acid catalysts useful in preparing the reaction product include benzene sulfonic acid, xylene sulfonic acid, toluene sulfonic acid, methanesulfonic acid, methane disulfonic acid, longer chain alkylsulfonic acids, boron trifluoride, solid resin or polymers that contain sulfonic acid groups such as Amberlyst 15 or Nafion, sulfuric acid or the like. The weight of the acid used to catalyze the reaction will range from 0.04 to 20 percent by weight based on the weight of the phenolic compound.

The temperature of the reaction mixture can range from room temperature to about 180° C. After the combination of reactants is stirred, a mild exotherm can result. After the exotherm ceases, the reaction mixture is gradually elevated in temperature of up to 180° C., while the water of reaction is removed.

Following the reaction, the solid acid catalyst is removed by filtration. Alternatively, the liquid acid catalyst can be neutralized. Representative of the caustic materials which may be used to neutralize the reaction mixture after water production has ceased (completion of reaction) include sodium hydroxide, potassium hydroxide, sodium carbonate, sodium bicarbonate, and the like. The reaction mixture should be cooled to below 100° C. prior to addition of the caustic. The amount of caustic added is that amount sufficient to neutralize the acid catalyst.

Depending upon the specific reactants utilized, the reaction product may either be a liquid at room temperature or a low melting point solid.

One aspect of the instant invention is the criticality of the molar ratios of the reactants. Based on 2 moles of the alkylated phenol, from 0.5 to 1.5 moles of the alkyldithio compound have been found suitable; more preferred is a ratio of from 0.75 to 1.25 moles of alkyldithio compound per mole of the phenolic compound. The most preferred molar ratio is 2:1. Ratios outside of these ranges result in poorer product performance and difficult handling.

The amount of formaldehyde utilized is generally equal to or in slight excess of the moles of alkylated phenol. Without limitation, it is believed that the reaction product from the acid catalyzed azeotropic condensation reaction of 2 moles of 2,4-di-t-butylphenol, I mole of dithioethane and 2 moles of formaldehyde includes compounds of the following structure:

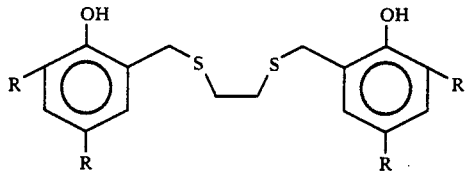

wherein R=t—butyl.

The reaction products useful in the invention may be added to or dispersed within the liquid hydrocarbonaceous medium in need of antifouling protection in an amount of 0.5-10,000 ppm based upon one million parts of the liquid hydrocarbonaceous medium. Preferably, the antifoulant is added in an amount of from 1 to 2500 ppm.

The reaction products may be dissolved in a polar or non-polar organic solvent, such as heavy aromatic naphtha, toluene, xylene, or mineral oil and fed to the requisite hot process fluid or they can be fed neat thereto. These products are especially effective when added to the liquid hydrocarbonaceous medium during the heat processing thereof at temperatures from 200°-550° C.

The invention will now be further described with reference to a number of specific examples which are to be regarded solely as illustrative, and not as restricting the scope of the invention.

EXAMPLES

Preparation of the sulfur-containing Mannich Reaction Products

In a 2-L, two-necked, round-bottomed flask equipped with a thermometer and magnetic stirrer were mixed with stirring 41.2 grams (0.20 mole) of 2,4-di-t-butylphenol, 100.0 ml of xylene, 8.4 ml (9.4 gram, 0.10 mole) of 1,2-dithioethane., 1.0 grams of Nafion (acid catalyst), and 6.0 gram (0.20 mole) of paraformaldehyde.

The mixture was stirred at approximately 30° C. for 1 hour, then heated to 105° C. over 50 minutes. The mixture was heated with stirring at 100° to 105° C. for 2 hours. A Dean-Stark trap was inserted and the temperature increased to 155° C. over 52 minutes. About 3.5 ml of water and 25 ml of xylene were collected in the Dean-Stark trap. The Nafion catalyst was removed by filtration. The resulting solution was yellow and clear with a slight sulfur smell. About 115.5 grams of product (about 45% active) was designated SMANN.

Another reaction product of 2,4-di-t-butylphenol, 1-2-dithioethane, and paraformaldehyde that was base catalyzed instead of acid catalyzed produced a reaction product which precipitated. This product was not considered suitable for antifoulant evaluation. The reaction of a phenol compound, a mercaptan and formaldehyde yielded a substituted thio cresol in U.S. Pat. No. 3,553,270 when the reaction was performed utilizing a base catalyst.

Antifoulant Tests

In order to ascertain the antifoulant efficacy of the antifoulant treatment in accordance with the invention, process fluid is pumped from a Parr bomb through a heat exchanger containing an electrically heated rod. Then, the process fluid is chilled back to room temperature in a water cooled condenser before being remixed with the fluid in the bomb. The system is pressurized by nitrogen to minimize vaporization of the process fluid. This apparatus is described in U.S. Pat. No. 4,578,178.

In this particular example, the rod temperature is controlled at a desired temperature. As fouling occurs, less heat is transferred to the fluid so that the process fluid outlet temperature decreases. Antifoulant protection was determined by comparing the summed areas between the heat transfer curves for control and treated runs and the ideal case for each run. In this method, the temperatures of the oil inlet and outlet and rod temperatures at the oil inlet (cold end) and outlet (hot end) are used to calculate U-rig coefficients of heat transfer every 2 minutes during the tests. From these U-rig coefficients, areas under the fouling curves are calculated and subtracted from the non-fouling curve for each run. Comparing the delta areas of control runs (averaged) and treated runs in the following equation results in a percent protection value for antifoulants.

$$\% \text{ Protection} = \left[1 - \frac{\Delta \text{ area}(UMAX - \Delta\text{area(treatment)}}{\text{avg}[\Delta\text{area}(UMAX) - \Delta\text{area(untreated)}]}\right] \times 100$$

The results of this antifoulant testing are presented in Table I.

TABLE I

Dual Fouling Apparatus
Desalted Crude Oils
125 ppm active SMANN treatments

| Crude Oil | Rod Temp. (°C.) | Percent Protection |
|---|---|---|
| A | 343 | 41, 11 (26 avg.) |
| B | 427 | 56, −4 (26 avg.) |
| D | 496 | 23 |

Additional testing was performed utilizing the dual fouling apparatus by adding iron naphthenate or asphaltene containing residuum to desalted crude oils. This results in even further fouling. SMANN reduced the fouling caused by this crude oil and contaminants. The results of this testing are presented in Table II.

The percent protection of the SMANN in these experiments was determined using the following equation:

$$\% \text{ Protection} = \left[1 - \frac{\Delta \text{ area}(UMAX - \Delta\text{area(treatment + contaminant)}}{\text{avg}[\Delta\text{area}(UMAX) - \Delta\text{area(contaminant)}]}\right] \times 100$$

TABLE II

Dual Fouling Apparatus
Desalted Crude Oils
25O ppm Active SMANN Treatments

| Crude Oil | Rod Temp (°C.) | Contaminant | Percent Protection |
|---|---|---|---|
| A | 343 | 5 ml, frac bottoms[1] | 38 |
| B | 427 | 5 ml, frac bottoms[1] | 18 |
| B | 427 | 30 ppm Fe (Naphthenate) | 33 |
| C | 399 | 5 ml, frac bottoms[1] | 13 |

[1]asphaltene containing residuum (2.86 Wt. %).

Another series of tests adapted to assess candidate efficacy in providing fouling inhibition during low to moderate temperature treatment of liquid hydrocarbon medium were performed. These tests are entitled the "Hot Filament Fouling Tests" and were run in conjunction with gas oil hydrocarbon medium. The procedure for these tests involves the following:

A preweighed 24-gauge Ni-chrome wire is placed between two brass electrodes in a glass reaction jar and held in place by two brass screws. 200 mls of feedstock are measured and added into each sample jar. One sample jar is left untreated as a control with other jars being supplied with 125 ppm (active) of the candidate material. The brass electrode assembly and lids are placed on each jar and tightly secured. The treatments are mixed via swirling the feedstock. Four sample jars are connected in series with a controller provided for each series of jars.

The controllers are turned on and provide 8 amps of current to each jar. This amperage provides a temperature of about 125°–150° C. within each sample jar. After 24 hours of current flow, the controllers are turned off and the jars are disconnected from their series connection. The wires, which have been immersed in the hot medium during the testing, are carefully removed from their jars, are washed with xylene and acetone, and are allowed to dry with the weight of the deposit being calculated. The deposit weight for a given wire was calculated in accordance with $$\text{wt. deposit} = \begin{pmatrix}\text{weight of wire}\\ \text{plus deposit}\end{pmatrix} - \text{(original wire weight)}$$

The percentage protection for each treatment sample was then calculated as follows:

$$\% \text{ protection} = \left[1 - \frac{\text{wt. deposit(treated)}}{\text{wt. deposit(untreated)}}\right] \times 100$$

Results are shown in Table III.

TABLE III

| Additives | ppm Actives | Feedstock Type | % Protection |
|---|---|---|---|
| SMANN | 125 | SRLGO | −65 |
| SMANN | 125 | CCLGO | 94 |

In Table III SRLGO means straight run light gas oil from a midwestern refinery with CCLGO indicating a catalytic cracked light gas oil from the same midwestern refinery. When tested in the SRLGO, the SMANN failed to provide antifoulant efficacy. When tested in the CCLGO, the SMANN provided excellent antifoulant efficacy. These results indicate that the reaction products of Example III would be expected to reduce fouling at temperatures below 150° C. However, most fouling problems in petroleum or petrochemical processing occur at temperatures of from about 200° C.–550° C.

As the examples clearly demonstrate, use of the SMANN antifoulants of the instant invention provide antifoulant protection in liquid hydrocarbons.

The antifoulants of the invention may be used in any system wherein a petrochemical or hydrocarbon is processed at elevated temperatures, and wherein it is desired to minimize the accumulation of unwanted matter on heat transfer surfaces. For instance, the antifoulants may be used in fluid catalytic cracker unit slurry systems wherein significant amounts of inorganic catalyst are present in the hydrocarbon-containing process stream. An FCC slurry stream is the bottoms products stream off a separation unit from an FCC. The catalyst fines are present in the slurry as a contaminant and can contribute to fouling of process equipment.

While this invention has been described with respect to particular embodiments thereof, it is apparent that numerous other forms and modifications of this invention will be obvious to those skilled in the art. The appended claims and this invention generally should be construed to cover all such obvious forms and modifications which are within the true spirit and scope of the present invention.

Having thus described the invention, what we claim is:

1. A method of inhibiting fouling deposit formation in a liquid hydrocarbonaceous medium during heat treatment processing thereof, wherein in the absence of such antifouling treatment, fouling deposits are normally formed as a separate phase within said liquid hydrocarbonaceous medium thereby impeding process throughput and thermal transfer, said method comprising adding to said liquid hydrocarbonaceous medium an antifouling amount of a sulfur-containing Mannich reaction product that is derived by admixing a phenol with an alkyldithio compound, an aldehyde compound and an acid catalyst.

2. The method as claimed in claim 1 wherein said phenol is selected from the group comprising monobutylated phenol, 2,4-dibutylated phenol, nonylphenol, 2,4-dinonylphenol, dodecylphenol, methylphenol and 2,4-dimethylphenol.

3. The method as claimed in claim 1 wherein said alkyldithio compound is 1,2-dithioethane.

4. The method as claimed in claim 1 wherein said aldehyde compound is paraformaldehyde.

5. The method as claimed in claim 1 wherein said solid acid catalyst contains a sulphonic acid group.

6. The method as claimed in claim 1 wherein said sulfur-containing Mannich reaction product is added in an amount from about 0.5 parts to about 10,000 parts by weight per million parts of said liquid hydrocarbonaceous medium.

7. The method as claimed in claim 1 wherein said liquid hydrocarbonaceous medium comprises crude oil, or catalytically cracked light gas oil.

8. The method as claimed in claim 1 wherein said reaction product is added to said liquid hydrocarbonaceous medium during heating of said medium at a temperature of from about 200° C. to 550° C.

* * * * *